US006676426B2

(12) United States Patent
Sturgeon et al.

(10) Patent No.: US 6,676,426 B2
(45) Date of Patent: Jan. 13, 2004

(54) ELECTRICAL CONNECTOR WITH BAISED POSITIONING

(75) Inventors: Scott D. Sturgeon, Vancouver, WA (US); David C. Johnson, Portland, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 94 days.

(21) Appl. No.: 09/925,400

(22) Filed: Aug. 9, 2001

(65) Prior Publication Data

US 2003/0032319 A1 Feb. 13, 2003

(51) Int. Cl.[7] ..... H01R 13/64

(52) U.S. Cl. ..... 439/247; 439/295; 439/552; 439/571

(58) Field of Search ..... 439/247, 571, 439/552, 553, 554, 555, 295

(56) References Cited

U.S. PATENT DOCUMENTS 3,244,941 A 4/1966 Maynard et al.
5,002,497 A * 3/1991 Plocek et al. ..... 439/248
5,071,374 A * 12/1991 Plocek et al. ..... 439/752
5,199,900 A * 4/1993 Hayes, Sr. ..... 439/557
5,921,813 A 7/1999 Patel et al.
5,980,313 A 11/1999 Kunishi et al.
6,031,909 A 2/2000 Daoud
6,033,064 A 3/2000 Pawlowski, Jr. et al.
6,068,507 A 5/2000 Popa
6,095,854 A 8/2000 Sommer et al.

* cited by examiner

*Primary Examiner*—T. Nguyen

(57) ABSTRACT

An electrical connector is positioned in a biased manner relative to a receptacle upon mating. The mated electrical connector is positioned along a first positioning axis of the receptacle in predetermined electrical contact with a target circuit. The connector includes a housing that mates with the receptacle along a mating axis and is placed at a predetermined position along an orthogonal first positioning axis. The housing also defines a first-positioning-axis datum which engages the receptacle. Furthermore, the connector includes an electrically conductive contact structure mounted on the housing, and a biasing mechanism operatively coupled with the housing. The biasing mechanism acts to maintain the first-positioning-axis datum in abutment with the receptacle upon mating of the housing with the receptacle.

5 Claims, 4 Drawing Sheets

ELECTRICAL CONNECTOR WITH BAISED POSITIONING

FIELD OF THE INVENTION

The present invention relates generally to electrical connectors, and more specifically to an electrical connector including a biasing mechanism configured to position a datum of the connector along a positioning axis orthogonal to a mating axis of the connector with a receptacle.

BACKGROUND

Electrical connectors are fundamental to routing electrical connections between separate electrical circuits. For example, information stored in a stand-alone memory component may be accessed by a processor after electrical connection is made through an electrical connector. Typically, this electrical connection is made by electrical contact with conductive contact pads on a surface of the component or a corresponding circuit board. The electrical connector generally provides contact pins, or other conductive structures, that are aligned with, and capable of, touching each of the contact pads.

In order to properly align conductive structures, a mating receptacle may be used that positionally constrains the connector. In addition, the mating receptacle may directly constrain the position of a component, or may provide a reference structure for locating the component relative to the connector. Placing precise positional constraints on the connector or component facilitates precise alignment of the contact pins and the contact pads. Without this alignment, one or more pins may miss a contact pad, may connect to the wrong pad(s), or may simultaneously connect to plural contact pads, creating a short circuit.

The need for precise alignment between the contact pins and pads is also dictated by economic considerations. In digital electronics, for example, gold may be used to form each contact pad because of its high conductivity and low propensity for corrosion. Therefore, the cost of a component may be reduced by decreasing the area of each contact pad, and thus the amount of gold in each contact pad. However, the savings from smaller contact pads may be offset by a need for smaller dimensional tolerances during manufacturing of the connector, the receptacle, and the component. Without these smaller tolerances, the tolerances of the receptacle, connector, and component may stack up to produce an overall tolerance greater than the size of the contact pad. The result may be unreliable performance of the connector.

Alignment between the connector pins and the contact pads varies, in part, due to manufacturing tolerances for features of the connector, receptacle, and component, but also because of movable positioning of the connector in the receptacle. Therefore, the precision with which the receptacle and connector are mated may help define acceptable manufacturing tolerances.

The most precise positioning may be achieved with a receptacle dimensioned to tightly receive the connector. However, for practical reasons, the fit cannot be too tight. A tightly fitting connector may be difficult to remove. In addition, a tight fit may require a substantial force to be exerted by a user when the connector and receptacle are mated. As a result, the connector may forcefully move into the mating position, impacting and potentially damaging a pre-positioned component.

Based on the problems associated with a tight fit, arrangements have been provided so that the connector easily mates with the receptacle. However, in this unbiased mating, the connector is allowed to float within the space provided by the receptacle. The resulting variable position of the connector may produce inconsistent connector performance due to significant tolerance stack-up.

An alternative approach to reducing tolerance stack-up involves snap-fitting a connector into a receptacle. In this approach, bias mechanisms on each of two opposing walls bias the connector away from the walls of the receptacle. Although this snap-fit approach may reduce the ability of the connector to float within the receptacle, the approach may fail to precisely position the connector relative to one of the two opposing walls. Instead, competition between the resilience of each of the two bias mechanisms may position the connector at an intermediate but somewhat variable position.

SUMMARY OF THE INVENTION

The present invention provides an electrical connector that is positioned in a biased manner relative to a receptacle upon mating. The mated electrical connector is positioned along a first positioning axis of the receptacle in predetermined electrical contact with a target circuit. The connector includes a housing configured to mate with the receptacle along a mating axis for placement at a predetermined position along an orthogonal first positioning axis. The housing also defines a first-positioning-axis datum configured to engage the receptacle. Furthermore, the connector includes an electrically conductive contact structure mounted on the housing, and a biasing mechanism operatively coupled with the housing. The biasing mechanism acts to maintain the first-positioning-axis datum in abutment with the receptacle upon mating of the housing with the receptacle.

DETAILED DESCRIPTION

The present invention provides an electrical connector with a biased positioning mechanism that locates a datum of the connector relative to a receptacle. The positioning mechanism defines the datum position along a first positioning axis of the receptacle that is substantially orthogonal to a mating axis along which the connector is moved to mate with the receptacle. Correspondingly, other features of the connector, such as contact structures, may be more accurately located relative to the receptacle. Furthermore, a target circuit, and its relevant connector contact locations, may be more effectively located along the receptacle first positioning axis based on the defined position of the connector datum. The net result of this more precise positioning of the connector may be a minimized tolerance stack-up and a reduced size of expensive contact features on either the connector or target circuit, or both.

Figure 1:
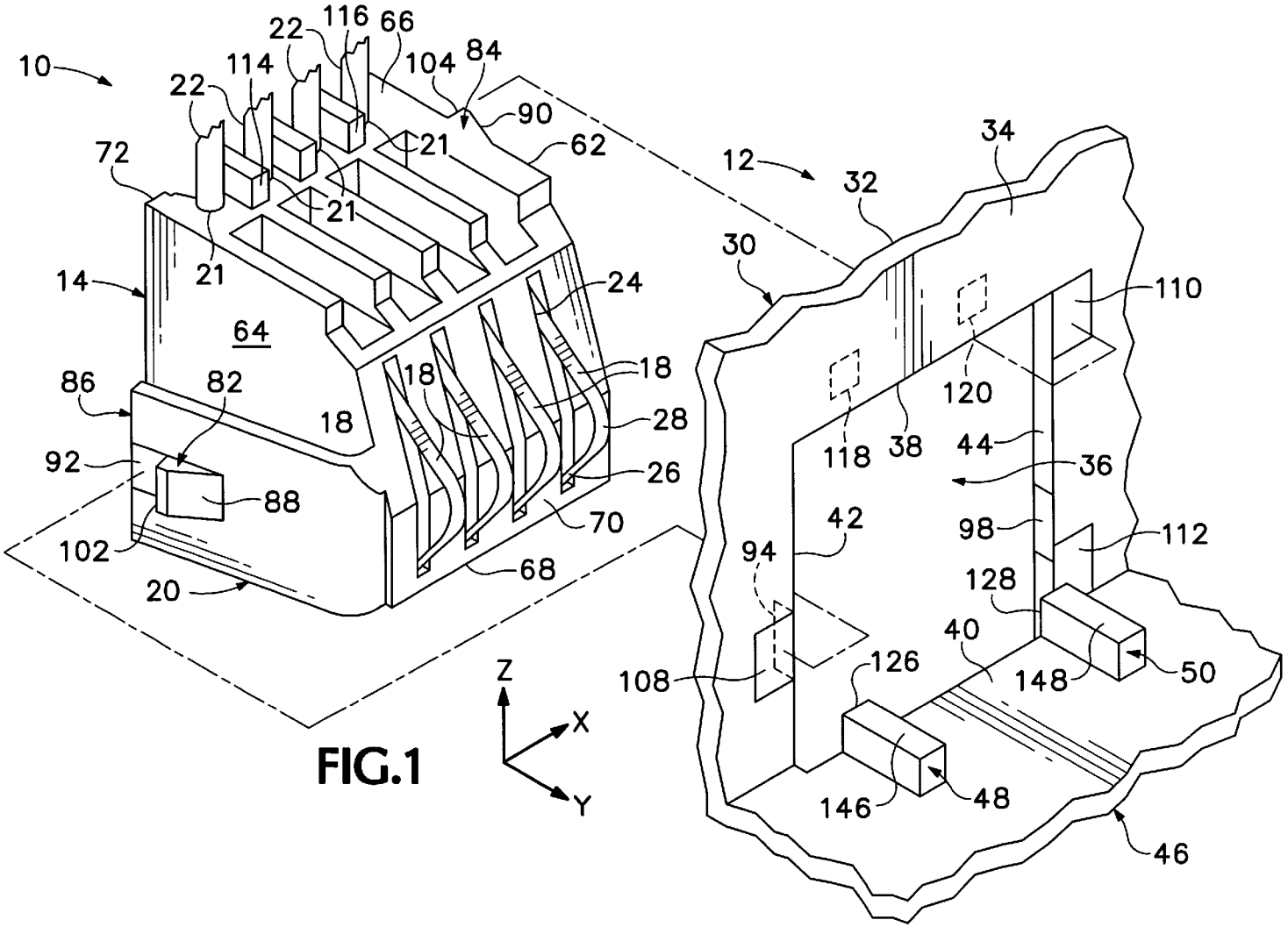
FIG. 1 is an isometric view of a connector and a corresponding receptacle constructed according to one embodiment of the present invention.

FIG. 1 shows an example of a connector 10 and its corresponding receptacle 12 produced according to one embodiment of the present invention. Connector 10 may be used, for example, to contact a memory component mounted on an ink supply cartridge so as to link the memory chip to another circuit on a printer. As shown, connector 10 includes a housing 14, electrically conductive contact structures 18, and a biasing mechanism 20. Housing 14 holds base portions of contact structures 18. Biasing mechanism 20 positions the connector, in a biased manner, along a positioning axis of the receptacle, as will be detailed below.

Furthermore, housing 14 defines electrical access locations 21 which provide internal conduits for electrical connection to contact structures 18. When connected to a target circuit, one or more of the contact structures 18 electrically connect conductors entering the access locations to the target circuit. Thus, the connector functions by providing a conductive link between a target circuit and a second circuit.

Figure 4:
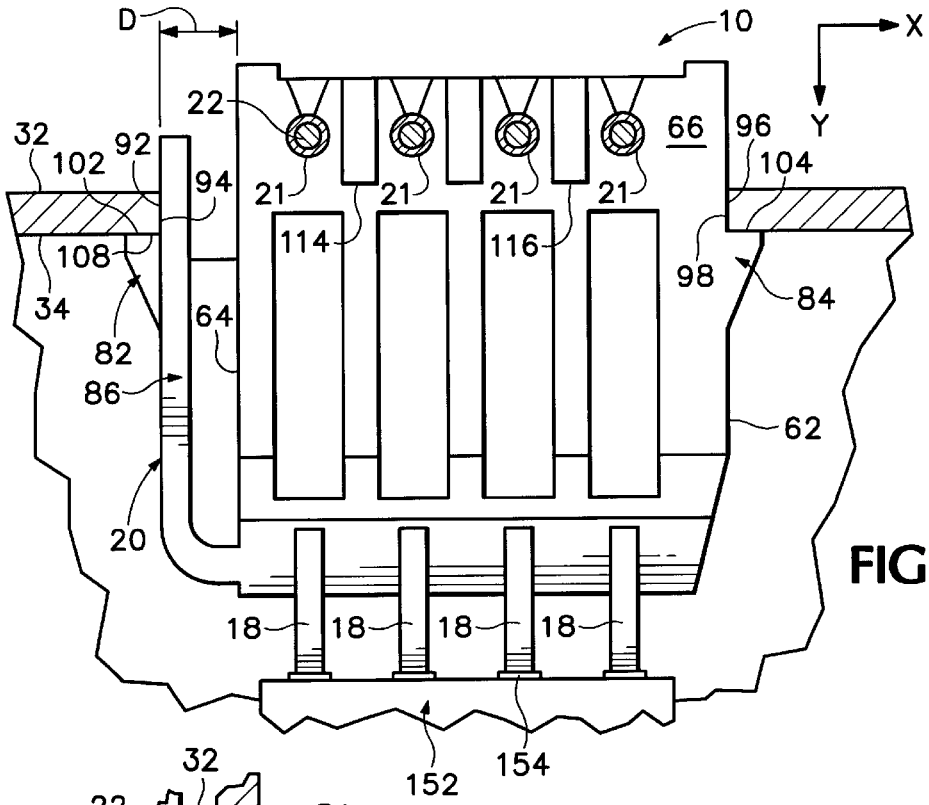
FIG. 4 is a top view of the connector and receptacle of FIG. 3, viewed generally along line 4—4, and showing the connector contacting a target circuit.

As shown in FIG. 1, access locations 21 may provide housing regions into which separate conductors 22 may be inserted (also see FIG. 4). For example, connector 10 may be manufactured so that each access location has a thin insulating covering (not shown) that is disrupted by insertion of the conductor. Insertion of the conductor into an access location may effect clamping of the conductor in a conductive position. Alternatively, conductors may be integrally formed with the housing and extend away from the access locations. The conductors may be bundled and joined with other conductors, connected to other connectors, or may be connected directly to other circuits.

Figure 5:
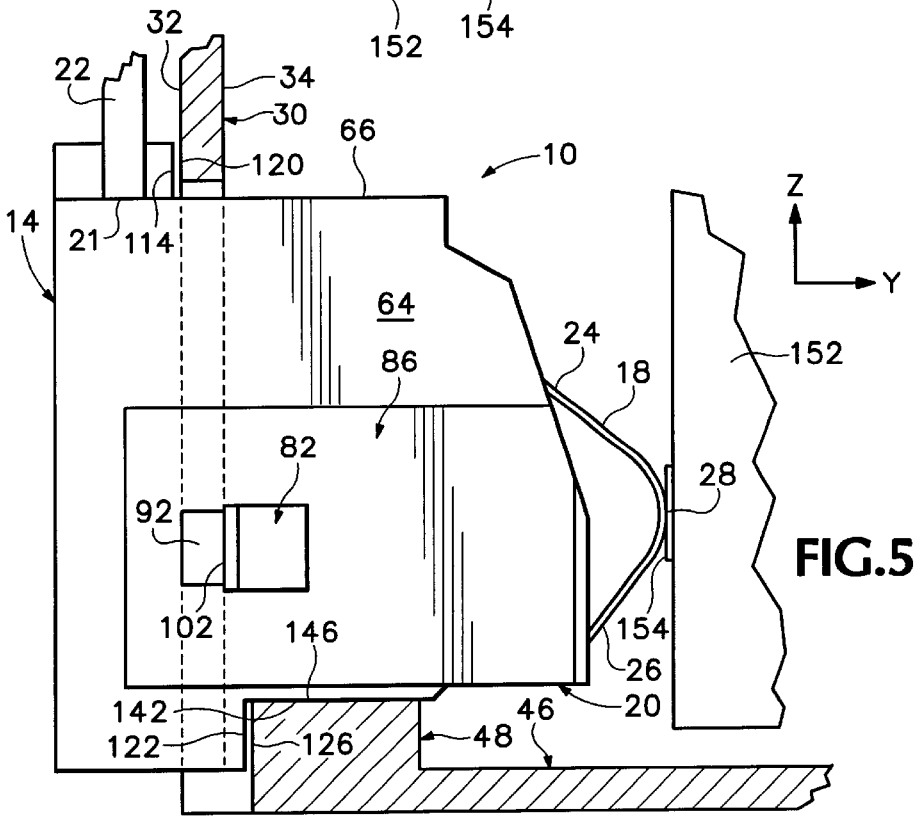
FIG. 5 is a side view of the connector of FIG. 3, viewed generally along line 5—5, and showing the connector contacting a target circuit.

As used herein, a contact structure is any externally available conductive structure that is positioned for conductive contact with a target circuit through receptacle mating. In FIG. 1, contact structures 18 extend from housing 14 to form generally parallel resilient loops, each contact structure extending from opposite ends 24 and 26 of a slot, and joining a conductor 22 within the housing. The contact structures may be resilient, and thus may be deformed somewhat from their resting positions, shown in FIGS. 1 and 2, by contact with a target circuit, as shown in FIGS. 4 and 5. In an alternative embodiment, contact structures may be mounted on the housing, but not extend from the housing.

As shown best in FIG. 5, contact structures 18 may include central contact portions 28 that are spaced from the exterior housing 14. In the depicted embodiment, the contact structures have a generally arcuate geometry, but other geometries, such as angular or linear, may also be suitable. A contact structure may be constructed of a non-corrosive conductive material, and may include gold, or be gold-plated.

In accordance with the present invention, housing 14 mates with the receptacle, and positions the connector relative to the receptacle upon mating. The housing also generally fixes the positions of the access locations and the contact structures relative to each other within the connector and at least partially insulates electrical connections between access locations and contact structures. Although any insulating material may be used, glass-filled polybutylene terephthalate has been found to be a suitable material for the housing, based on cost, dimensional stability, chemical robustness, and mechanical properties.

Receptacle 12 is dimensioned to receive and hold housing 14 according to the present invention. Upon mating, the housing and receptacle may be referred to as being in mated relation. Receptacle 12 provides a mating structure for housing 14 to hold the connector in a constrained or fixed position. The receptacle 12 thus may act as a direct positioning structure for defining position of connector 10, and may act as a direct or indirect positioning structure for a target circuit.

In the embodiment shown in FIG. 1, receptacle 12 takes the form of a wall 30 with an entry-limiting side 32 and an exit-limiting side 34. Wall 30 defines a receiving passage 36 through which the connector travels and then occupies when mating with the receptacle. Passage 36 is dimensioned so that wall 30 abuts portions of connector 10, as will be shown and described below. Although receiving passage 36 is shown herein as a through-hole, it will be appreciated that passage 36 may be a recess, for example, where the receptacle and the target circuit are formed together. Passage 36 may be bounded by top edge 38, bottom edge 40 and side edges 42 and 44. In this example, bottom edge 40 is provided by floor 46, which is connected to wall 30 and includes connector supports 48 and 50.

Housing 14 has an exterior region that may include first and second side walls 62 and 64, respectively, a top wall 66, and a bottom support wall 68. Housing 14 also may include a front contact wall 70, and back wall 72. Fixed positioning/abutment structures, referred to as datums, may be defined by the walls to fix the housing position relative to the receptacle, as described in detail below. Datums may be reference points defined by surfaces, structures, or regions on the housing and may be defined by surfaces of the housing that abut the receptacle. The connector also includes a biasing mechanism 20 with a positioning surface that cooperates with at least one datum on the housing to locate the datum along a first positioning axis of the receptacle.

To facilitate discussion of the biasing mechanism, the positioning structures, and the datums, a set of coordinate axes has been indicated in the figures. The y-axis is parallel to the mating axis. Connector 10 moves in a positive direction along the mating axis to mate with receptacle 12, and generally in the negative direction along the mating axis to remove connector 10 from the receptacle. The x-axis is parallel to a first positioning axis in this embodiment. The x-axis extends generally orthogonal to first side wall 62 and second side wall 64, when the housing is mated with the receptacle. As will be described below, biasing mechanism 20 serves to precisely locate a connector x-datum of first side wall 62 along a first positioning axis of the receptacle. The z-axis is parallel to a second positioning axis in this embodiment, and may be referred to in this case as a support axis. The support axis may be substantially aligned with gravity.

Connector 10 may abut and engage the receptacle at several positions to fix the position of the connector relative to the receptacle. In the present embodiment, the connector may abut the receptacle at seven positions. As will be described below, one of the seven positions may be a positioning surface provided by biasing mechanism 20, thus six housing datums may be used by connector 10 to completely determine its position relative to receptacle 12. Each housing datum may engage the receptacle at a predetermined location along one of three orthogonal receptacle axes. In the example of connector 10, as will be detailed below, one datum engages the receptacle along the first positioning axis (defining a point), three datums engage the receptacle along axes parallel to the mating axis (defining a plane), and two datums engage the receptacle along axes parallel to the second positioning axis (defining a line). However, these six datums may be distributed differently between these three axes to define a point, a line, and a plane. Furthermore, the connector and receptacle may be designed so that the connector does not define six datums, based on the specific requirements for mating of the connector.

Mating between housing 14 and receptacle 12 will now be described to illustrate the locations of datums and other positioning structures on the housing and receptacle, and the action of the biasing mechanism. To effect mating, a user generally positions the connector so that the perimeter of the housing is aligned with passage 36 of the receptacle as shown in FIG. 1. The connector may then be moved forward along the mating axis until projections 82 and 84 meet wall 30 along side edges 42 and 44, respectively, on entry-limiting side 32. Projection 82 may be defined on resilient positioning structure 86 of biasing mechanism 20. Projection 84 may be defined on first side wall 62. The projections provide an arrangement whereby the connector snaps in place when the connector is moved sufficiently along the mating axis.

As indicated, each projection may include a beveled edge, 88 and 90. Edges 88 and 90 tend to provide an inwardly directed force, which deflects resilient positioning structure 86 along the positive x-axis. This deflection may occur as the connector approaches mating relation with the receptacle and the projections are urged past side edges 42 and 44 of receptacle wall 30. Once projections 82 and 84 clear wall 30, resilient positioning structure 86 may return to a more outward position, thus seating connector positioning surface 92 against receptacle engagement surface 94 of side edge 42. In addition, connector fixed x-datum 96 (shown best in FIG. 2) will abut receptacle x-datum 98 of side edge 44. Abutted connector x-datum 96 and receptacle x-datum 98 may thus be used as references for dimensioning and locating the connector, receptacle, and target circuit along the first positioning axis.

Because resilient positioning structure 86 is flexibly positionable, distance D (shown in FIG. 4 as extending between positioning surface 92 and second side wall 64) may vary. Accordingly, some variation in the width of passage 36 and/or housing 14 is possible without altering the abutment between connector x-datum 96 and receptacle x-datum 98. It will be appreciated that connector x-datum 96 may be variously placed at desired locations on a connector wall provided the biasing mechanism and its positioning surface are on an opposing side of the connector. Furthermore, it will be appreciated that the biasing mechanism may determine more than one x-datum on an opposing wall.

Biasing mechanism 20 is exemplified in resilient positioning structure 86. In this embodiment, a cantilever projects from second side wall 64, and bends orthogonally to extend generally parallel to second side wall 64 (see FIG. 4). The cantilever may be configured to extend at an angle relative to the second side wall 64 prior to mating, but may move into a parallel arrangement with the second side wall upon mating of the housing with the receptacle. Furthermore, the cantilever may extend from another wall of the housing. Although shown as a cantilever, the resilient positioning structure may include any resilient structure capable of moving between non-engaged and engaged positions. Other examples of a resilient positioning structure may include a spring, a compressible side wall, or any other suitable mechanism.

Mated housing 14, in the absence of a target circuit, may be variably positioned along the mating/y-axis by including appropriate connector and receptacle y-datums and y-stops. Three connector y-datums 102, 104, and 106 (shown in FIGS. 1 and 2 on projections 82, 84) may abut receptacle y-datums 108, 110 and 112, respectively, located on exit-limiting side 34 adjacent to passage 36. Connector y-datums 102, 104, and 106 thus may oppose removal of the connector, and maintaining mating relation between the housing and the receptacle. In contrast, one or more y-axis stops may be used to control how far connector 10 may be inserted along the mating axis. These stops may be positioned on any wall (such as top wall 66 and bottom support wall 68) of the housing, and on entry-limiting side 32 of the receptacle. For example, connector y-stops 114, 116, shown in FIGS. 1, 4, and 5, may oppose receptacle y-stops 118, 120, respectively. Connector y-stops 122, 124, shown in FIG. 2, may oppose receptacle y-stops 126, 128, respectively, as shown in FIG. 5.

Connector y-datums 102, 104, and 106 resist movement of the connector out of the passage, negative along the mating axis, and fix the mated position along the mating axis in response to a biasing force directed in a negative direction along the mating axis (shown in FIGS. 4 and 5). In contrast, y-stops 114, 116, 122, and 124 may not typically abut wall 30, except when the connector is urged too far into the passage along the mating axis. Therefore, without a target circuit in position, connector 10 may be fixedly positioned along the x-axis, but may not be fixedly positioned along the y-axis. Specifically, connector 10 may move between contact with sides 32 and 34 of receptacle 12.

Figure 2:
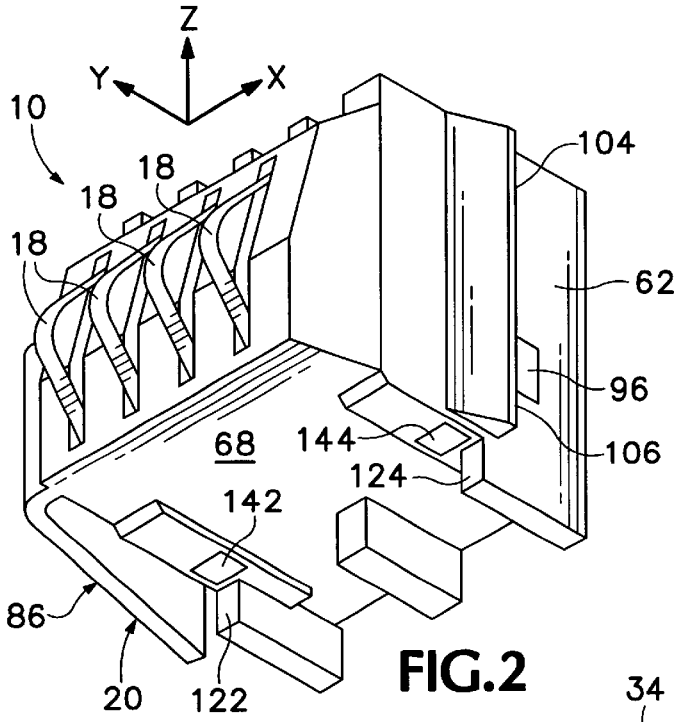
FIG. 2 is another isometric view of the connector of FIG. 1, viewed from below and behind the connector as depicted in FIG. 1.
Figure 3:
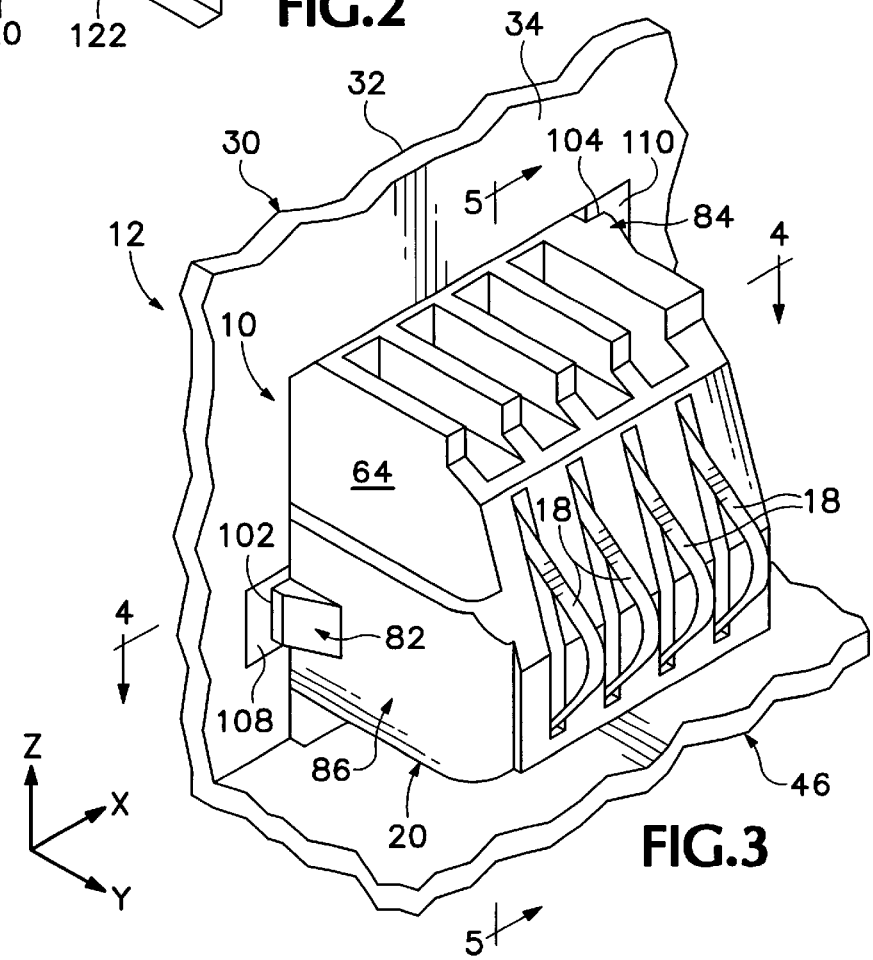
FIG. 3 is an isometric view of the connector and receptacle of FIG. 1 in a mated configuration.

Positioning of connector 10 along the z-axis may be determined by at least two connector z-datums, 142, 144, placed on bottom support wall 68 (FIG. 2). Connector z-datums 142, 144 may abut receptacle z-datums 146, 148 (provided in this case by supports 48 and 50). In this configuration, gravity may bias connector 10 so that connector z-datums 142, 144 abut receptacle z-datums 146, 148 and thus fix the position of the connector along the z-axis, relative to the receptacle. However, connector 10 also may include a biasing mechanism (not shown) to define the position of the connector along the z-axis. Such a biasing mechanism may be particularly helpful in applications where the orientation of the receptacle axes relative to gravity is not fixed.

FIGS. 4 and 5 show an example of a target circuit 152 biasing the mated housing in a negative direction along the mating axis. In this example, the target circuit is a component with contact pads 154 located generally orthogonal to the y-axis. However, any target circuit may be used in which contact surfaces of the target circuit may be presented to the contact structures of the connector. Connector 10 receives a biasing force from target circuit 152, which may be fixed, so that connector y-datums 102, 104, and 106 abut exit-limiting side 34 of receptacle 12 at receptacle y-datums 108, 110, and 112, respectively. As described above and illustrated in FIG. 5, connector y-stops 114, 116, 122, and 124 may be slightly spaced from side 32 of wall 30 or floor 46 in this biased position. Connector 10 may be removed from the mated position by applying a force on first side wall 62, directed along the first positioning axis in a negative direction. This force will press resilient positioning structure 86 toward second side wall 64, allowing projection 84 of first side wall 62 to be rotated past wall 30 of the receptacle, thus freeing the captive connector.

Figure 6:
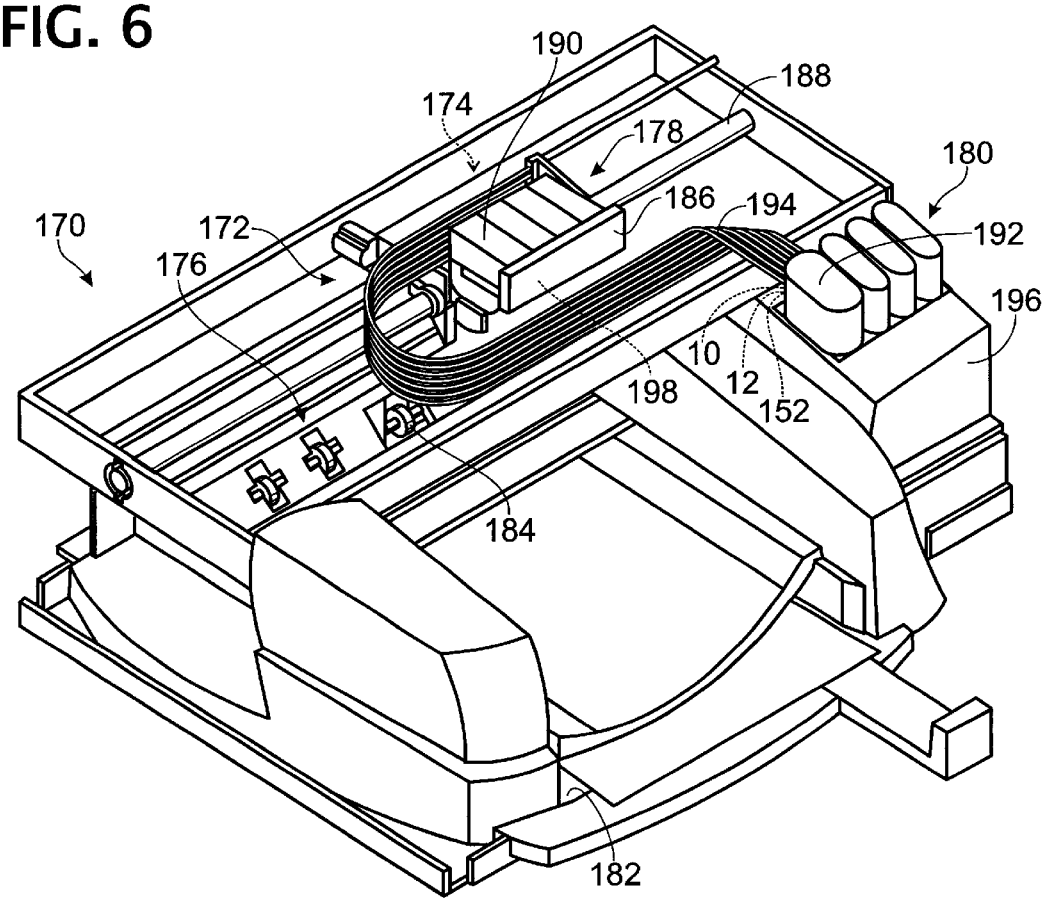
FIG. 6 is an isometric view of an inkjet printer that includes the connector, receptacle, and target circuit of FIG. 4.

Connector 10 may be used to provide conductive connection between circuits. For example, as shown in FIG. 6, connector 10 may be used in an inkjet printer 170 to provide conductive connection between circuit portions of the printer. Printer 170 generally includes an ink delivery system 172 and a control circuit 174. Ink delivery system 172 includes all mechanical assemblies and structures that function to positionally expel ink onto print media. In contrast, control circuit 174 regulates operation of the ink delivery system as detailed below.

Ink delivery system 172 generally comprises a media positioning mechanism 176, an ink application mechanism 178, and an ink supply mechanism 180. Positioning mechanism 176 positions print media relative to ink application mechanism 178, and ink application mechanism 178 applies ink provided by ink supply mechanism 180.

Positioning mechanism 176 feeds print media into position before and during printing. Positioning mechanism 176 may include a media tray 182 configured to hold print media, which is fed into printer 170. Positioning mechanism 176 may also include one or more rollers 184 or other media movement structures for moving print media from media tray 182 to various printing positions relative to ink application mechanism 178, and for moving print media out of printer 170 once printing has been completed. Furthermore, while the depicted printer 170 is configured to print on sheet media, a printer using an electrical connector according to the present invention may be configured to print on any other desired type of media without departing from the scope of the present invention.

Ink application mechanism 178 generally comprises any mechanism for applying ink to print media. Mechanism 178 may include a carriage 186 that reciprocates along a scanning axis determined by carriage support rail 188. One or more printheads 190 may be mounted on carriage 186 for expelling ink onto print media. Carriage 186 and carriage support rail 188 may support and facilitate positioning of printhead 190 relative to print media.

Ink supply mechanism 180 generally comprises any mechanism that stores ink and provides ink to application mechanism 178. Ink application mechanism 180 may include a plurality of ink supplies 192 containing ink for printing. Ink supply mechanism 180 of the depicted embodiment is configured to hold four ink supplies 192, one for black ink and one for each of the primary colors. However, ink supply mechanism 180 may hold either more or fewer ink supplies, depending upon whether the printer is configured to print in color or only black-and-white, and how the printer mixes inks to form colors. Supply mechanism 180 may also include ink conduits 194 that provide fluid connection between ink supply mechanism 180 and ink application mechanism 178. Ink supply mechanism 180 of the depicted embodiment is positioned at a location remote from the printheads, referred to as "off-axis". However, each ink supply 182 may also be positioned on carriage 186 and also may be formed integrally with a printhead. Other examples of inkjet printers and printing systems that may be suitable for use in the present invention are described in U.S. Pat. No. 5,984,450 issued to Becker et al., Nov. 16, 1999; No. 5,984,457 issued to Taub et al., Nov. 16, 1999; No. 6,033,064 issued to Pawlowski et al., Mar. 7, 2000; and No. 6,050,666 issued to Yeoh et al., Apr. 18, 2000, each of which is hereby incorporated by reference.

Control circuit 174 generally comprises one or more electrically interconnected circuit portions that regulate aspects of ink delivery system 172. Circuit portions may regulate any aspect of communication with an external processor or any other aspect of ink delivery system 172 including media positioning mechanism 176, ink application mechanism 178, and ink supply mechanism 180. For example, circuit portions may determine print media movement and may sense aspects of the print media, such as presence or absence, quantity, size, quality, manufacturer, and the like. Circuit portions may also determine or sense various aspects of the ink application mechanism, such as carriage position and movement, printhead use, printhead firing pattern, ink drop size, printhead cleaning, printhead sensing, and the like. Furthermore, circuit portions may also determine or sense various aspects of the ink supply mechanism. For example circuit portions may store and/or sense ink supply parameters, such as date or site of manufacture, flow rate, or ink volume, viscosity, formulation, or color. Furthermore, circuit portions may also be used to signal presence or absence of ink supply 192.

The control circuit may include circuit portions that act as processors or memory devices. For example, printer 170 may include a main processor circuit, a carriage processor circuit, a printhead circuit, an ink supply circuit, and/or any other circuits that regulate an aspect of the ink delivery system. In the example of FIG. 6, connector 10 is mated with receptacle 12 provided by body 196 of printer 170. Connector 10 conductively contacts circuit portion 152 on ink supply 182, providing electrical connection between ink supply target circuit 152 and another circuit portion, carriage circuit 198, which in this case is a processor on carriage 186. However, connector 10 may mate with any receptacle that positions the electrical connector for conductive contact with any circuit portion that is configured to regulate ink delivery system 172. For example, connector 10 may conductively contact a carriage processor circuit, a main processor circuit, a printhead circuit, and the like, and thus may provide electrical connection between any of these circuit portions.

The disclosure set forth above may encompass multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the inventions of the present disclosure.

We claim:

1. An electrical connector configured for predetermined electrical contact with a target circuit via a connector receptacle, the connector comprising:

a housing adapted to mate with the receptacle along a mating axis that is substantially orthogonal to a first positioning axis, the housing defining a mating-axis datum and a first-positioning-axis datum that are each nonmovable relative to the housing;

a plurality of resilient electrically conductive contact structures connected to the housing, the resilient contact structures being configured to urge the mating-axis datum in a direction generally parallel to the mating axis into abutment with the receptacle in response to contact between the contact structures and the target circuit; and a resilient positioning mechanism coupled with the housing and movable relative to the housing, the resilient positioning mechanism being configured to engage the receptacle opposite the nonmovable first-positioning-axis datum, to urge the first-positioning-axis datum in a direction generally parallel to the first positioning axis into abutment with the receptacle.

2. The electrical connector of claim 1, wherein the housing is adapted to mate in a first direction along the mating axis, and wherein the direction the resilient contact structures are configured to urge the mating-axis datum is a second direction that is at least substantially opposite to the first direction.

3. The electrical connector of claim 1, wherein the housing defines at least one second-positioning-axis datum adapted to engage the receptacle at a predetermined location along a second-positioning axis defined by the receptacle, the second positioning axis being orthogonal to the first positioning axis and the mating axis.

4. The electrical connector of claim 1, wherein the resilient positioning mechanism is a cantilever.

5. The electrical connector of claim 1, wherein the housing includes a projection, the projection defining the mating-axis datum.

* * * * *